US007082997B2

(12) United States Patent
Slack

(10) Patent No.: US 7,082,997 B2
(45) **Date of Patent: *Aug. 1, 2006**

(54) PIPE CENTRALIZER AND METHOD OF ATTACHMENT

(75) Inventor: Maurice William Slack, Edmonton (CA)

(73) Assignee: Tesco Corporation, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/480,783

(22) PCT Filed: Jun. 13, 2002

(86) PCT No.: PCT/CA02/00883

§ 371 (c)(1),
(2), (4) Date: Jun. 8, 2004

(87) PCT Pub. No.: WO02/103154

PCT Pub. Date: Dec. 27, 2002

(65) Prior Publication Data

US 2004/0231854 A1 Nov. 25, 2004

(30) Foreign Application Priority Data

Jun. 15, 2001 (CA) ..... 2350681

(51) Int. Cl.
*E21B 17/10* (2006.01)

(52) U.S. Cl. ..... 166/378; 29/505; 166/241.6; 166/242.6; 175/325.5

(58) Field of Classification Search ..... 166/241.6, 166/241.4, 241.3, 242.6, 242.1, 378, 380; 29/505–508; 175/325.5, 325.3
See application file for complete search history.

(56) References Cited

U.S. PATENT DOCUMENTS

| | | | | |
|---|---|---|---|---|
| 1,959,367 | A | 5/1934 | Kennedye | |
| 2,424,027 | A | 7/1947 | Gist | |
| 2,715,552 | A | 8/1955 | Lane | |
| 3,360,846 | A | 1/1968 | Schellstede et al. | |
| 3,499,210 | A | 3/1970 | Schellstede et al. | |
| 3,945,446 | A | 3/1976 | Ostertag et al. | |
| 4,000,549 | A * | 1/1977 | Brumley et al. | 175/325.5 |
| 4,101,179 | A * | 7/1978 | Barron | 175/325.5 |
| 4,105,262 | A | 8/1978 | Richey | |
| 4,245,709 | A * | 1/1981 | Manuel | 175/325.5 |
| 4,319,393 | A * | 3/1982 | Pogonowski | 29/434 |
| 4,330,924 | A * | 5/1982 | Kushner et al. | 29/458 |
| 4,630,690 | A * | 12/1986 | Beasley et al. | 175/57 |

(Continued)

FOREIGN PATENT DOCUMENTS

| | | |
|---|---|---|
| CA | 2328190 | 6/2001 |

(Continued)

*Primary Examiner*—Hoang C. Dang
(74) *Attorney, Agent, or Firm*—Bennett Jones LLP

(57) ABSTRACT

A crimpable centralizer has been invented for installation on pipe, such as would be useful in well bore drilling and casing operations. The present invention provides a centralizer having a cylindrical body which when coaxially placed over a pipe and substantially radially inwardly displaced at a plurality of points (i.e. crimped) about the circumference of a section of the cylindrical body, attaches to the pipe to create a connection having structurally significant axial and torque load transfer capacity. When crimped according to the methods of the present invention, the load transfer capacity of the connection between the centralizer and the pipe can be arranged to substantially prevent significant relative movement of the centralizer on the pipe under loads that may be encountered when using one or more of the pipes as components of a tubular string used for drilling or completing well bores.

6 Claims, 3 Drawing Sheets

U.S. PATENT DOCUMENTS

| | | | | |
|---|---|---|---|---|
| 4,868,967 | A | 9/1989 | Holt et al. | |
| 5,070,597 | A | 12/1991 | Holt et al. | |
| 5,566,754 | A * | 10/1996 | Stokka | 166/241.6 |
| 5,961,157 | A | 10/1999 | Baron et al. | |
| 6,006,830 | A * | 12/1999 | Barron et al. | 166/241.6 |
| 6,409,226 | B1 | 6/2002 | Slack et al. | |
| 6,679,335 | B1 * | 1/2004 | Slack et al. | 166/380 |
| 2001/0006109 | A1 | 7/2001 | Kaiser et al. | |
| 2004/0206509 | A1 * | 10/2004 | Slack | 166/378 |

FOREIGN PATENT DOCUMENTS

| | | |
|---|---|---|
| EP | 0 783 074 | 7/1997 |
| WO | WO 02/02904 | 1/2002 |
| WO | WO 02/04783 | 1/2002 |
| WO | WO 02/103155 | 12/2002 |
| WO | WO 02/103156 | 12/2002 |

* cited by examiner

PIPE CENTRALIZER AND METHOD OF ATTACHMENT

FIELD OF THE INVENTION

The present invention relates to centralizers attached to pipe placed in boreholes. The invention discloses centralizers and methods of attachment to enable transfer of structurally significant axial and torsional loads between the centralizer and pipe.

BACKGROUND OF THE INVENTION

The processes of drilling and completing well bores in earth materials using tubular strings are frequently benefited if the tubular string is prevented from fully eccentering and generally contacting or laying against the borehole wall. Numerous devices, typically referred to as centralizers, are employed to provide this function of reducing eccentricity, or centralizing, the tubular string within the borehole. These devices are configured to economically meet a variety of drilling and completion applications.

Within the context of petroleum drilling and well completions, wells are typically constructed by drilling the well bore using one tubular string, largely comprised of drill pipe, then removing the drill pipe string and completing by installing a second tubular string, referred to as casing, which is subsequently permanently cemented in place. The requirements for centralizers historically used on these two types of strings is thus significantly different.

Drilling places the severest structural demands on centralizers since they must survive extended periods of time in rotating contact with the borehole wall. Centralizers suitable for drilling must therefore be rugged and may be reused. To meet these requirements drilling centralizers are typically integral with the drill string, and may be relatively expensive since they are reused.

In contrast, centralizers used for casing are not typically required to withstand significant rotation, are typically optimized to improve cementing quality and are only used once. These requirements have led to casing centralizers that attached to the exterior of the connection by means having little or no torsional and limited axial load transfer capacity. As a single use item, they are constructed for lowest cost not durability. With this historic method of well construction, both the drill pipe and casing centralizer designs are separately optimised for the different performance requirements of the drilling and completion operations respectively.

Recent advances in drilling technology have enabled wells to be drilled and completed with a single casing string, eliminating the need to 'trip' the drill pipe in and out of the hole to service the bit and make room for the casing upon completion of drilling. This change is motivated by potential cost savings arising from reduced drilling time and the expense of providing and maintaining the drill string, plus various technical advantages, such as reduced risk of well caving before installation of the casing.

However, using casing to both drill and complete the well changes the performance requirements of the casing centralizers employed. Casing centralizers, as employed in the prior art, typically rotate relative to the casing body under application of extended rotation required for drilling, causing wear of the centralizer, casing or both, leading to potential failure of the centralizer or casing. Adapting the integral centralizer architecture employed for drill string centralizers, while providing a technically feasible means to centralize casing for drilling, is costly and more complex to implement than simply attaching to the casing exterior. What is required are inexpensive casing centralizers that are rugged, comparatively easy to attach to the casing and able to withstand drilling rotation sufficient to complete at least one well.

SUMMARY OF THE INVENTION

A crimped centralizer has been invented for installation on metal pipe, such as would be useful in well bore drilling and casing operations. The present invention provides a centralizer having a cylindrical body which when coaxially placed over a metal pipe and substantially radially inwardly displaced at a plurality of points (i.e. crimped) about the circumference of a section of the cylindrical body, attaches to the pipe to create a connection having structurally significant axial and torque load transfer capacity. When crimped according to the methods of the present invention, the load transfer capacity of the connection between the centralizer and the pipe can be arranged to substantially prevent significant relative movement of the centralizer on the pipe under loads that may be encountered when using one or more of the metal pipes as components of a tubular string used for drilling or completing well bores.

The metal pipe on which the centralizer of the present invention is installed must be capable of accepting the hoop stresses of crimping without becoming unstable, for example, without buckling or crumpling. This generally requires that the pipe be thick-walled, for example, having an external diameter to thickness ratio ("D/t") less than 100 and preferably less than 50.

To be most generally useful for these applications, the centralizer should be amenable to rapid field installation on joints of pipe having at least one non-upset end. In addition, the centralizer, once installed should not substantially reduce the minimum diameter (drift diameter) through the pipe.

Thus, in accordance with a broad aspect of the present invention, there is provided a metal centralizer comprising: a body having an outer facing surface and an inner bore therethrough sufficiently large to allow insertion therethrough of a selected metal pipe having an external diameter, at least one tubular section on the body, the portion of the inner bore extending through the tubular section having an internal diameter capable of loosely fitting about the external diameter of the metal pipe and a centralizing section on the body including a plurality of bearing surfaces extending outwardly from the outer facing surface.

The tubular section can be cylindrical or largely cylindrical with some radial variations to the internal diameter or outer surface. The tubular section should be circumferentially continuous such that a hoop stress can be set up by radially inwardly displacement (i.e. crimping) at a plurality of points about the circumference of the outer surface of the section. The tubular section should be capable of accepting the hoop stresses of crimping without becoming unstable, for example, without buckling or crumpling. This generally requires that the section be thick-walled, for example, having an external diameter to thickness ratio ("D/t") less than 100 and preferably less than 50.

The loose fit of the section about the pipe must be sufficient to accommodate the variations of the outer diameter of the metal pipe intended to be used.

The bearing surfaces can be for example ribs, lines of weldments etc.

In accordance with the present invention there is also provided, a method to attach a centralizer to a metal pipe by crimping, the metal pipe having an outer surface, such method comprising the steps of: providing a metal pipe; providing a centralizer having a body with an inner bore therethrough sufficiently large to allow insertion therethrough of the metal pipe, a plurality of outward facing bearing surfaces on the body and at least one tubular section on the body having an internal diameter capable of fitting about the outer surface of the metal pipe; inserting the metal pipe through the inner bore of the centralizer, applying an inward, substantially radially-directed force to a plurality of points about an outer circumference of the tubular section causing it to plastically deform inwardly and come into contact with the outer surface of the pipe, applying such additional inward, substantially radially directed force as required to force both the centralizer and the outer surface of the metal pipe to displace inwardly an amount at least great enough so that when the force is released, an interference fit is created between the centralizer and the metal pipe.

Preferably, the inward, substantially radially directed force is not so great that the drift diameter of the metal pipe is excessively reduced. Frictional forces enabled by the interference fit at the inwardly displaced section provide the mechanism by which structurally significant axial and torsional load may be transferred between the centralizer and metal pipe without slippage therebetween.

The ability of the crimping method to thus ensure a residual interference fit without compromising the drift diameter is dependent on appropriate selection of various parameters as will be apparent to one skilled in the art. Where the application permits, from the point where plastic deformation of the centralizer induced during crimping has reduced the original loose fit to come into contact with the metal pipe of the method, differential temperature may be used to control interference according to the well known methods of shrink fitting, whereby the differential temperature is obtained by heating the centralizer, cooling the metal pipe, or both, prior to crimping.

However for the present application it is preferable to avoid the requirement to either heat the centralizer or cool the metal pipe as required to obtain interference by shrink fitting. An additional purpose of the present invention is, therefore, to provide a method of obtaining sufficient interference in the crimped connection through purely mechanical means, without requiring a significant temperature differential between the centralizer and metal pipe at the time of crimping. This purpose is realized by selecting the elastic limit of the centralizer material, in the section to be crimped, to be less than that of the pipe on which the centralizer is to be installed. In this context, the elastic limit generally refers to the strain at which the metal of the parts yields. Having the material properties thus selected, it will be apparent to one skilled in the art, that when the radial displacement applied during crimping is sufficient to force the hoop strain of the metal pipe to be at least equal to its elastic limit, upon release of the load causing the radial displacement, the metal pipe will tend to radially 'spring back' an amount greater than the centralizer, were both parts separated. Since the parts are not separated, the difference in this amount of spring back is manifest as interference and fulfills the desired purpose of creating interference by purely mechanical means.

While a purely mechanical method of obtaining interference through crimping is desirable for most applications, the present invention also anticipates applications where thermal and mechanical methods can be combined.

A further purpose of the present invention is to facilitate the frictional engagement of the crimped centralizer to the thick-wall pipe. To meet this purpose, in one embodiment of the present invention the inside surface of centralizer, at least over the section to be crimped, is provided with a roughened surface finish. In a further embodiment, a friction enhancing material such as a grit epoxy mixture is disposed in the interfacial region of the crimped section. Similarly, various bonding materials may be disposed in the interfacial region prior to crimping to act as glues augmenting the frictional aspects of the connection once their shear strength is developed after setting.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF THE PREFERRED EMBODIMENT

Figure 1:
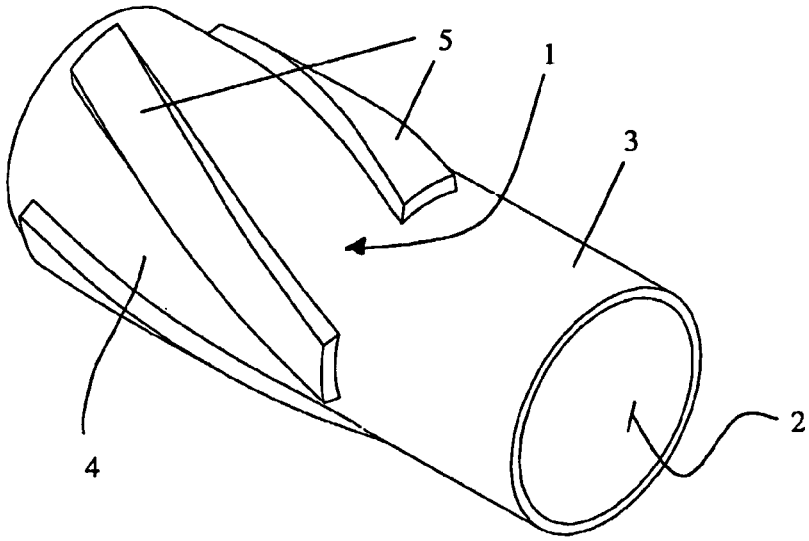
FIG. 1 is a perspective view of a centralizer according to the present invention.
Figure 2:
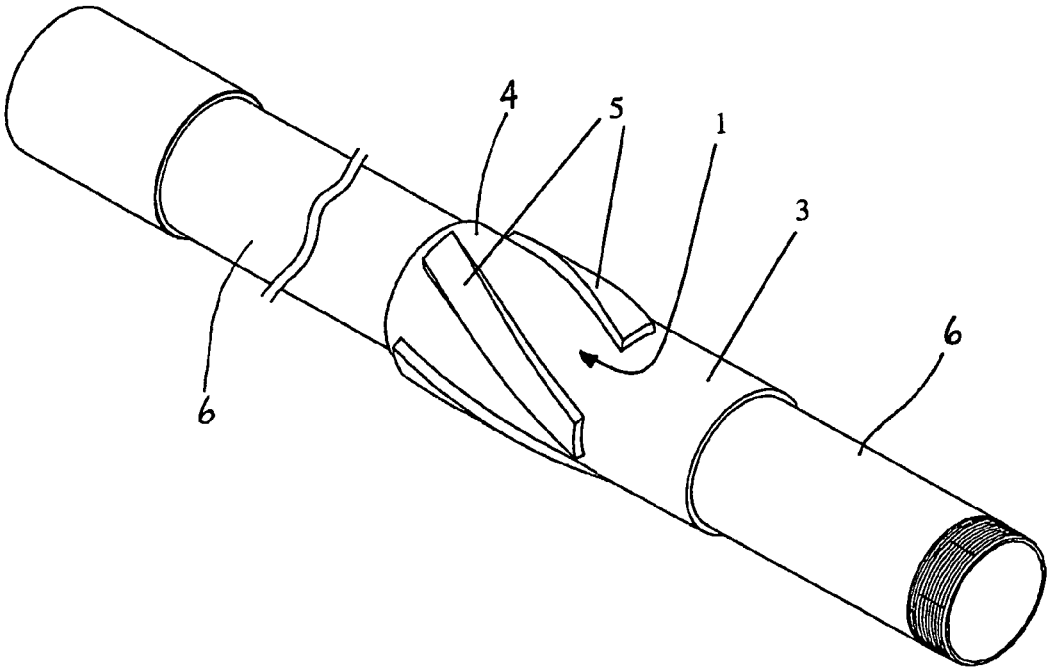
FIG. 2 is a perspective view of the centralizer shown in FIG. 1 placed on a joint of casing as it might appear before crimping.

According to the present invention, a centralizer is provided as shown in FIG. 1, and a method of crimping it to a thick-wall metal pipe when placed on the pipe as shown in FIG. 2.

Referring to FIG. 1, the centralizer is provided having a metal body 1 containing an internal bore 2, a cylindrical end 3 forming a section suitable for crimping, and a centralizing section 4 on which ribs 5 are placed.

The cylindrical end and the centralizing section are formed integral on the body and the internal bore passes through both of them. While the crimpable section in the illustrated embodiment is cylindrical end, it is to be noted that the crimpable section can be formed intermediate a pair of centralizing sections, if desired, rather than on an end. Also, it is to be noted that more than one crimpable section and more than one centralizing section can be provided on the centralizer, as desired.

Ribs 5 are evenly spaced around the centralizing section. There are at least three ribs spaced about the circumference of the centralizing section. Preferably, each rib is helically shaped and the number, length and pitch of the rib helixes are arranged to ensure the starting circumferential position of each rib overlaps the ending circumferential position of at least one adjacent rib. The ribs may be placed on the centralizer body by a variety of methods including milling, casting, welding or hydroforming.

The internal bore 2 of the centralizer body is selected to loosely fit over at least one end of a thick-wall metal pipe 6, shown as a threaded and coupled casing joint in FIG. 2. As shown, this allows the centralizer to be readily inserted over an end of the pipe 6 and placed somewhere along the length of the pipe joint prior to crimping. Thus placed, the crimping method of the present invention in its preferred embodiment provides a means to obtain a significant interference fit after crimping even where the centralizer and casing material are at similar temperatures prior to crimping. In applications where significant heating of the pipe and centralizer, after centralizer installation, is anticipated, the centralizer is preferably selected to have a thermal expansion coefficient that is equal to or less than that of the casing. Similarly in applications where cooling subsequent to crimping is anticipated, the opposite relationship between thermal expansion coefficients is preferred.

Figure 3:
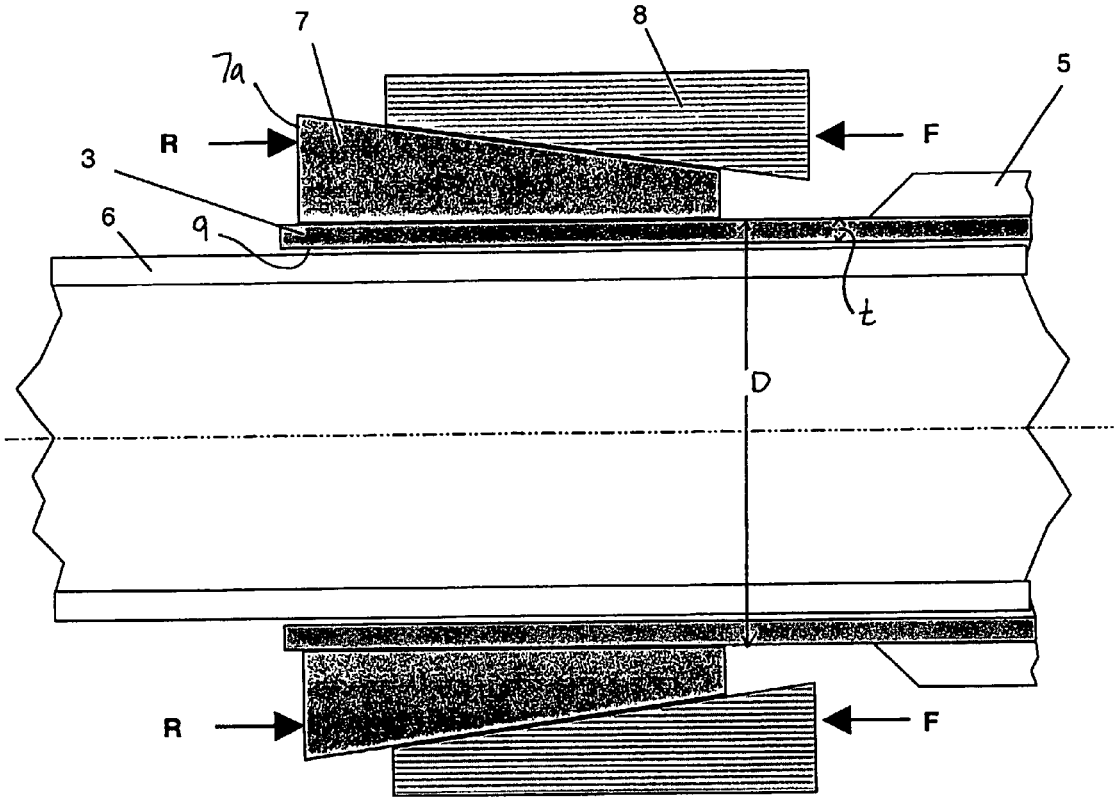
FIG. 3 is a partial sectional schematic view through the wall of a centralizer positioned coaxially on a casing joint and inside a collet crimping tool prior to application of radial crimping displacement.

Radial displacement required to crimp the centralizer cylindrical end 3 to the casing joint 6, on which it is placed, may be accomplished by various methods, however a fixture employing a tapered 'collet in housing' architecture was found to work well in practice. This well known method of applying uniform radial displacement, and consequently radial force when in contact with the exterior of a cylindrical work piece surface, employs a device as shown schematically in FIG. 3. The device retains the externally tapered fingers or jaws 7 of a collet (segments of an externally conical sleeve) inside a matching internally tapered solid housing 8. Application of axial setting force to the housing 8, as shown by vector F, which is reacted at the face 7*a* of the collet jaws 7, as shown by vector R, tends to induce the collet jaws 7 to penetrate into the collet housing 8 along the angle of its conical bore. This causes the jaws 7 to move radially inwardly and engage the work piece to be gripped, in the present case, shown as the cylindrical end 3 of a centralizer. (Alternately, the action of the collet may be described in terms of setting displacement, understood as axial displacement of the collet housing 8 with respect to the collet jaws 7. In this case the setting force is understood to arise correlative with the setting displacement.) The axial force F and reaction R are readily applied by, for example, a hollow bore hydraulic actuator (not shown), arranged with an internal bore greater than the casing 6 outside diameter.

Figure 4:
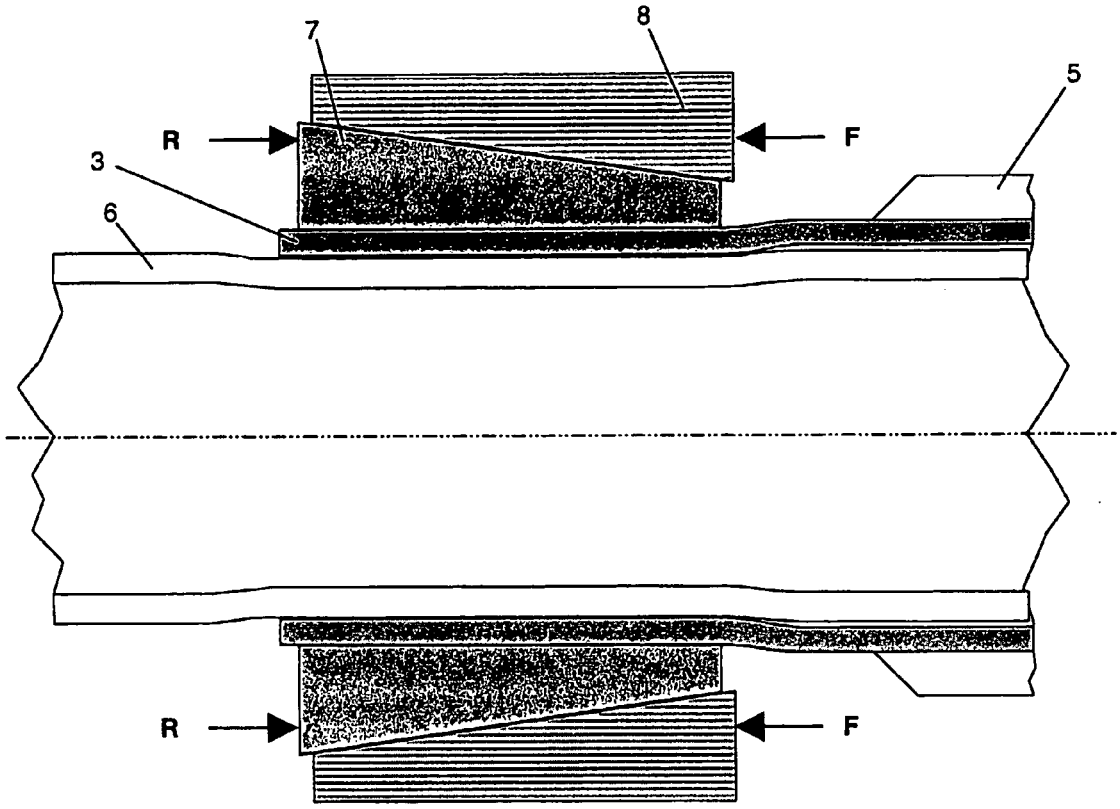
FIG. 4 is the partial sectional schematic view of the assembly shown in FIG. 3 as it would appear after application of radial crimping displacement.

With this arrangement, upon application of sufficient force (F), the jaws may be forced inward to first cause sufficient radial displacement to plastically deform the centralizer cylindrical end 3 and bring it into contact with the casing 6. This amount of radial displacement removes the annular clearance of the loose fit initially required for placing and positioning the centralizer on the casing 6. Application of additional setting force then forces both the centralizer cylindrical end 3, and the underlying wall of the casing 6, inward. In the preferred embodiment, the setting displacement is preferably applied until the hoop strain in the casing wall at the crimp location equals or slightly exceeds its elastic limit. It will be apparent to one skilled in the art that radial displacement beyond this point will cause little increase in residual interference but will have the undesirable effect of reducing the drift diameter of the casing joint 6. FIG. 4 schematically shows the collet, centralizer and casing as they might appear in the fully crimped position. After the desired radial displacement is achieved, the setting displacement of the collet is reversed which releases it from the centralizer allowing the collet to be removed, leaving the centralizer crimped to the casing.

To ensure that this method of cold crimping (i.e., mechanical crimping unassisted by thermal effects) results in sufficient residual interference between the centralizer cylindrical end 3 and the casing 6, in its preferred embodiment the centralizer material at the cylindrical end 3 has an elastic limit less than that of the casing 6. As is typically the case, the centralizer and casing material are both made from carbon steel having nearly the same elastic modulii. Therefore, the elastic limit may be expressed in terms of yield strength, since elastic limit is generally given by yield stress divided by elastic modulus.

For example, in one trial conducted to assess the torque capacity to be obtained by crimping a centralizer to 7 inch diameter API grade L80 26 ppf casing material (minimum specified yield strength of 80,000 psi), steel centralizer material having a measured yield strength of 47,000 psi was selected. The centralizer elastic limit was thus less than 50% that of the casing. Using this material, a centralizer having an outside diameter of 7.625 inches, an inside diameter of 7.125 inches and a machined inside bore, was constructed for one trial. After crimping this centralizer to the casing over a 3.5 inch section using the method of the present invention described above, the axial force required to displace the centralizer was measured to be approximately 20,000 lbf. Had this sliding force been applied through torsion, the required torque to induce sliding rotation of the centralizer relative to the casing would be 5833 ftlb. This may be compared to the maximum expected total drilling torque for this size of casing, which is in the order of 20,000 ftlb. Given this crimped centralizer configuration, the torque transferred between just one such centralizer and casing, would need to exceed 25% of the total worst case drilling torque, to induce slippage of the centralizer on the casing.

However, in certain applications it may be desirable to further enhance the load transfer capacity of a centralizer attached to casing, without increasing the crimped length, by improving the frictional engagement achieved for a given level of interference. While this may be accomplished by various means, roughening one or both of the cylindrical end inner wall or the casing outer surface on which the centralizer was to be crimped, was found to be particularly effective. In one trial using a centralizer configured similar to that described in the preceding example, but where the wall surface 9 defining the internal bore 2 of the centralizer was roughened by grit blasting prior to crimping, the equivalent torque capacity was increased approximately 70%.

The length of the section crimped will in general linearly affect the load transfer capacity of the crimped connection. For centralizers attached to full length casing joints, the length of section suitable for crimping, provided by the cylindrical end 3 may be extended almost without limit. Similarly the length of the collet jaws 7, do not limit length that may be crimped. The collet tool may be used to apply the required radial displacement at multiple axial locations to incrementally crimp an extended length cylindrical end 3. Increased load transfer capacity may thus be readily achieved by increasing the crimped section length.

It will be apparent that these and many other changes may be made to the illustrative embodiments, while falling within the scope of the invention, and it is intended that all such changes be covered by the claims appended hereto.

The invention claimed is:

1. A method for attaching a centralizer to a metal pipe by crimping, the metal pipe having an outer surface, such method comprising the steps of: providing a metal pipe; providing a centralizer having a body with an inner bore therethrough sufficiently large to allow insertion therethrough of the metal pipe, a plurality of outward facing bearing surfaces on the body and at least one tubular section on the body having an internal diameter capable of fining about the outer surface of the metal pipe; inserting the metal pipe through the inner bare of the centralizer, applying an inward, substantially radially-directed force to a plurality of points about an outer circumference of the tubular section causing it to plastically deform inwardly and come into contact with the outer surface of the pipe at points corresponding to the plurality of points; and applying such additional inward, substantially radially directed force as required to force both the centralizer and the outer surface of the metal pipe to displace inwardly an amount at least great enough so that when released, an interference fit is created between the centralizer and the metal pipe.

2. The method of claim 1 wherein at least one of the outer surface of the pipe arid an inner surface of the tubular section is roughened to facilitate frictional engagement therebetween.

3. A wellbore casing assembly comprising: at least a section of wellbore casing; and a wellbore casing centralizer crimped onto the at least a section of well bore casing, the wellbore casing centralizer including a body having a first end and a second end opposite the first end, an outer facing surface and an inner bore extending therethrough from the first end to the second end sufficiently large to allow insertion therethrough of the external diameter the section of wellbore casing, at least one crimpable tubular section on the body through which the wellbore casing centralizer is crimped about the external diameter of the section of wellbore casing and a centralizing section on the body including a plurality of bearing surfaces extending outwardly from the outer facing surface.

4. The wellbore casing assembly of claim 3 wherein the crimpable tubular section has an external diameter to thickness ratio of less than 100.

5. The wellbore casing assembly of claim 3 wherein the crimpable tubular section has an external diameter to thickness ratio of less than 50.

6. The wellbore casing assembly of claim 3 wherein the crimpable tubular section is circumferentially continuous such that hoop stress can be generated therein.

* * * * *